US011326604B2

(12) United States Patent
North et al.

(10) Patent No.: US 11,326,604 B2
(45) Date of Patent: May 10, 2022

(54) MULTI-STAGE VACUUM PUMP AND A METHOD OF DIFFERENTIALLY PUMPING MULTIPLE VACUUM CHAMBERS

(71) Applicant: Edwards Limited, Burgess Hill (GB)

(72) Inventors: Phillip North, Burgess Hill (GB); Ian Olsen, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 29 days.

(21) Appl. No.: 16/954,466

(22) PCT Filed: Apr. 4, 2019

(86) PCT No.: PCT/GB2019/050973

§ 371 (c)(1),
(2) Date: Jun. 16, 2020

(87) PCT Pub. No.: WO2019/202297

PCT Pub. Date: Oct. 24, 2019

(65) Prior Publication Data

US 2021/0079914 A1 Mar. 18, 2021

(30) Foreign Application Priority Data

Apr. 16, 2018 (GB) ..... 1806177

(51) Int. Cl.
*F04C 25/02* (2006.01)
*F04C 18/12* (2006.01)
(Continued)

(52) U.S. Cl.
CPC ..... *F04C 25/02* (2013.01); *F04C 18/126* (2013.01); *F04C 18/16* (2013.01); *F04C 23/00* (2013.01); *F04C 29/12* (2013.01)

(58) Field of Classification Search
CPC ..... F04C 25/02; F04C 18/126; F04C 18/16; F04C 18/12; F04C 29/12; F04C 28/26; F04B 37/14
See application file for complete search history.

(56) References Cited

U.S. PATENT DOCUMENTS 6,776,588 B1 * 8/2004 Arndt ..... F04B 25/005 417/250
6,796,773 B1 * 9/2004 Choi ..... F04C 18/3562 417/218

(Continued)

FOREIGN PATENT DOCUMENTS

CN 2809273 Y 8/2006
CN 101473208 A 7/2009

(Continued)

OTHER PUBLICATIONS

Translation of the Notification of Reason for Rejection from counterpart Japanese Application No. 2020-563828, dated Jul. 19, 2021, 2 pp.

(Continued)

*Primary Examiner* — Audrey B. Walter
*Assistant Examiner* — Dapinder Singh
(74) *Attorney, Agent, or Firm* — Shumaker & Sieffert, P.A.

(57) ABSTRACT

A multi-stage positive displacement vacuum pump and a method of differentially pumping multiple vacuum chambers using such a pump is disclosed. The pump comprises a housing for housing at least one rotor mounted for rotation on a corresponding at least one shaft and for pumping gas through the multiple stages for output through an exhaust. The housing comprises a first inlet configured to admit gas to an inlet stage of said vacuum pump, and a further inlet configured to admit gas to an intermediate stage of said vacuum pump. The pump is configured such that gas admitted through each of the first and further inlets is pumped together as a combined gas flow by at least one stage of said vacuum pump downstream of said intermediate stage.

14 Claims, 4 Drawing Sheets

(51) Int. Cl.

| | |
|---|---|
| ***F04C 23/00*** | (2006.01) |
| ***F04C 29/12*** | (2006.01) |
| ***F04C 18/16*** | (2006.01) |

(56) References Cited

U.S. PATENT DOCUMENTS

| | | | | |
|---|---|---|---|---|
| 7,850,434 | B2 | 12/2010 | Stones | |
| 8,430,656 | B2 * | 4/2013 | Byun | A01N 43/36 418/11 |
| 9,810,597 | B2 | 11/2017 | Hilgers et al. | |
| 2005/0118035 | A1 | 6/2005 | Naito | |
| 2006/0090488 | A1 * | 5/2006 | Hwang | F04C 23/001 62/175 |
| 2006/0222506 | A1 | 10/2006 | Rival | |
| 2012/0132800 | A1 | 5/2012 | Stones | |
| 2013/0209222 | A1 | 8/2013 | Schofield | |
| 2013/0259711 | A1 | 10/2013 | Burggraf et al. | |
| 2015/0078927 | A1 | 3/2015 | Forni | |
| 2017/0200622 | A1 | 7/2017 | Shiokawa et al. | |

FOREIGN PATENT DOCUMENTS

| | | | |
|---|---|---|---|
| CN | 100559028 | C | 11/2009 |
| CN | 102473579 | A | 5/2012 |
| DE | 4439724 | A | 5/1996 |
| DE | 202013003855 | U1 | 7/2014 |
| EP | 1710440 | A2 | 10/2006 |
| GB | 2520787 | B | 6/2015 |
| JP | 2011106466 | A | 6/2011 |
| JP | 2013213498 | A | 10/2013 |
| WO | 2008027411 | A1 | 3/2008 |
| WO | 2009103701 | A1 | 8/2009 |
| WO | 2011121322 | A2 | 10/2011 |
| WO | 2015182699 | A1 | 12/2015 |

OTHER PUBLICATIONS

Translation of the First Office Action from counterpart Chinese Application No. 201980007712.7, dated Aug. 2, 2021, 8 pp.

Combined Search and Examination Report under 17 and 18(3) dated Oct. 19, 2018 in counterpart GB Application No. 1806177.0, 6 pp.

International Search Report and Written Opinion of the International Searching Authority dated Jun. 18, 2019 in counterpart International Application No. PCT/GB2019/050973, 6 pp.

* cited by examiner

State of the art

Embodiment

MULTI-STAGE VACUUM PUMP AND A METHOD OF DIFFERENTIALLY PUMPING MULTIPLE VACUUM CHAMBERS

This application is a national stage entry under 35 U.S.C. § 371 of International application No. PCT/GB2019/050973, filed Apr. 4, 2019, which claims the benefit of GB Application 1806177.0, filed Apr. 16, 2018. The entire contents of International application No. PCT/GB2019/050973 and GB Application 1806177.0 are incorporated herein by reference.

TECHNICAL FIELD

The field of the disclosure relates to multi-stage positive displacement pumps and to a method of differentially pumping multiple vacuum chambers.

BACKGROUND

Some vacuum systems such as mass spectrometry systems comprise multiple vacuum chambers where the pressure is reduced in stages through consecutive chambers. Each chamber communicates with adjacent chambers via a restriction and each requires individual pumping to provide the required vacuum. The pumping of such systems is conventionally done with a plurality of pumps, one or more for each chamber. Thus, there may be a high vacuum pump such as a turbomolecular pump for pumping the highest vacuum chamber, while lower vacuum chamber(s) are pumped by other lower vacuum pumps such as a scroll or Roots pump. The turbo pump is a secondary pump and as such is itself backed by a pump such as a scroll pump.

Such an arrangement requires multiple pumps with the associated costs and volume constraints.

It would be desirable to provide a cost and space efficient vacuum pump that would be suitable for differentially pumping multiple chambers.

SUMMARY

A first aspect provides a multi-stage positive displacement vacuum pump comprising a plurality of inlets, said vacuum pump comprising: a housing for housing at least one rotor mounted for rotation on a corresponding at least one shaft, for pumping gas through said multiple stages for output through an exhaust; said housing comprising said plurality of inlets, said plurality of inlets comprising a first inlet configured to admit gas to an inlet stage of said vacuum pump; and a further inlet configured to admit gas to an intermediate stage of said vacuum pump; wherein said pump is configured such that gas admitted through each of said first and further inlets are pumped together as a combined gas flow by at least one stage of said vacuum pump downstream of said intermediate stage.

The inventors of the present disclosure that the use of multiple pumps where differential pumping is required has cost and space implications for the system.

Some vacuum systems such as the compact mass spectrometry system, disclosed in GB2520787 have addressed this by providing a split-flow turbo pump, with the turbo pump having an interstage inlet in addition to the conventional inlet, the two inlets connecting to two different high vacuum chambers. However, a turbo pump is a secondary pump and requires backing by a further pump. Additionally, a turbo pump is not suitable for evacuating lower vacuum chambers of a multiple vacuum chamber system.

Pumps such as multi-stage positive displacement pumps that are suitable for the flow rates and pressures required for pumping the lower vacuum chambers of many multiple chamber vacuum systems and also for backing a turbo pump do not lend themselves easily to providing different pressures at multiple inlets. Thus, where differential pumping to different vacuums is required separate positive displacement pumps to provide each vacuum level are generally used.

In this regard a multi-stage positive displacement pump is designed to operate effectively for a particular flow rate and vacuum range. Each stage of the pump becomes smaller in size as the gas is compressed. The pump is sized based on the pressure of the gas at the inlet and the required flow rate and adapting such a pump to introduce a gas at a different pressure at a different inlet will increase the gas flow for a portion of the pump and be prone to cause overloading of the pump.

However, the inventors of the present disclosure recognized that in some circumstances, such as for multiple vacuum chamber systems, the flow rate and vacuums of the different chambers may be predictable and thus, the loading of a pump for pumping the chambers will also be predictable and a suitable design which provides one or more intermediate inlets that provide a different pressure from the inlet stage inlet and thereby allows differential pumping might be acceptable. This is particularly so, if the flow rate of the gas at such an intermediate inlet were significantly lower than the flow rate of the gas at the conventional inlet. Thus, a single pump may be provided which has multiple inlets connecting to different stages and provides effective differential pumping for particular applications, where multiple pumps are conventionally required. In effect the function of multiple pumps is provided within a single pump housing.

In some embodiments, said vacuum pump comprises a diversion channel for diverting gas flow from a pump stage on a first inlet side of said intermediate stage to a pump stage on an exhaust side of said intermediate stage.

The provision of a diversion channel allows gas from said first inlet to be diverted around the stage with the intermediate inlet, such that gas flow from said first inlet is combined with gas flow from said intermediate inlet at a stage on an exhaust side of said intermediate stage.

As noted above subsequent stages in a multi-stage pump will conventionally be at increasingly higher pressures. Furthermore, in order to reduce overloading effects on a pump when gas is introduced at an intermediate stage, it is preferable if the gas flow rate introduced at this stage is significantly lower than the gas flow rate from the inlet stage. However, where multiple vacuum chambers in a consecutive vacuum chamber system are pumped, conventionally the lower vacuum chambers have the higher flow rate requirements. Thus, if a multi-stage positive displacement pump is to provide differential pumping of two flows one at a lower flow rate and a higher vacuum and one at a higher flow rate and lower vacuum, there would seem to be competing requirements for which inlet should provide which pumping.

This is addressed in embodiments by providing a diversion channel within the pump so that the flow from the first inlet does not pass through the stage with the intermediate inlet. This allows the pressure of this intermediate stage to no longer be constrained to be higher than the "preceding" stage(s), that is those on the inlet stage side of the intermediate stage, as gas flow from these stages does not pass through this stage. This simple adaptation allows the pump to effectively differentially pump a higher vacuum, lower flow rate gas as well as a lower pressure, higher gas flow rate flow. This adaptation makes the pump particularly suitable for pumping a multiple vacuum chamber system, where the vacuum increases consecutively through adjacent chambers.

In summary, the gas flow rate associated with evacuating a lower vacuum chamber in a multiple vacuum chamber system is often high, while the gas flow rate of subsequent lower vacuum chambers is significantly lower. Thus, the pressure of the lower vacuum chambers would indicate that the inlet should be to an intermediate stage, while the flow rate would indicate that it should be to the inlet stage. However, these competing effects can be addressed by the provision of a diversion channel, allowing the intermediate stage with the intermediate inlet to be bypassed by gas flow from the first inlet.

In some embodiments, said intermediate stage comprises an outlet for diverting flow pumped by said intermediate stage towards a pump stage on the first inlet side of said intermediate stage.

Although the intermediate stage may be configured such that it outputs gas to an adjacent stage on an exhaust side of the intermediate stage during pumping, in some embodiments it may have an outlet that does not outlet to the subsequent stage but rather outlets to a diversion channel that diverts flow towards a stage on the inlet side of the intermediate stage. In this way, gas input at this intermediate stage will be pumped to a pumping stage that is at the higher vacuum, lower pressure side of the pump. This allows the intermediate inlet to effectively receive gas at a higher vacuum than would be the case if the intermediate stage were connected to the stages in the exhaust direction in a conventional way. Such an adaptation makes the pump particularly effective at differentially pumping a high flow rate, low vacuum gas and a significantly lower flow rate, higher vacuum gas. This may make it effective for pumping a multiple chamber vacuum system where the first inlet is connected to a lower vacuum chamber and the second inlet provides backing to a turbo pump evacuating a higher vacuum chamber, for example.

In other embodiments, said vacuum pump is configured such that said intermediate stage receives gas from an upstream stage and from said intermediate inlet.

Alternatively, the vacuum pump may simply be configured such that it pumps gas through adjacent stages from an inlet end to an exhaust end in a conventional manner. This may be acceptable where the intermediate stage receives a gas flow rate that is significantly lower than the gas flow rate at the first inlet and where this is at a similar pressure or at least not a significantly lower pressure than the pressure of the gas inlet at the first inlet.

Although the positive displacement vacuum pump may have a number of forms, in some embodiments it comprises one of a multiple stage Roots pump, a multiple stage claw pump or a multiple stage screw pump. The number of stages of a multiple stage screw pump is represented by the number of turns on the screw.

In some embodiments, said vacuum pump comprises twin rotors mounted to rotate on twin shafts.

In some embodiments, said vacuum pump comprises four or more stages arranged consecutively along said at least one shaft from said inlet stage, through a plurality of intermediate stages to an exhaust stage.

In some embodiments, said intermediate stage comprises one of a stage adjacent to said inlet stage or adjacent but one to said inlet stage.

The intermediate stage may be located in a number of different positions, but it may be advantageous for it to be close to the inlet stage as the larger size of stages towards the inlet end, allows an increased flow rate of gas to be input and it also allows the gas input to the pump at the intermediate stage to pass through several stages with the increased compression that this provides.

In some embodiments, said vacuum pump is configured to differentially pump multiple chambers, said first inlet being configured to connect to a lower vacuum chamber and said intermediate inlet being configured to act as a backing pump for a vacuum pump pumping a higher vacuum chamber.

As noted previously, providing an intermediate inlet to a positive displacement pump is not straightforward and in some circumstances can cause overloading of the pump. However, in systems with multiple vacuum chambers particularly those with consecutively increasing vacuums, then the pressure and flow rates of the different chambers may be predictable and a vacuum pump according to embodiments with an intermediate inlet may provide effective differential pumping of such chambers.

In some embodiments, said pump is configured to pump at a higher gas flow rate through said first inlet than through said intermediate inlet.

Adding gas at an intermediate inlet to a positive displacement pump works effectively where the gas flow rate input at the intermediate inlet is lower than the gas flow rate through the first inlet. In this regard, multiple stage positive displacement pumps have increasingly smaller volumes stages as the gas is compressed through the pump. Thus, it is advantageous if the higher flow rate is input to the first stage and the effect of gas being input to intermediate stages is reduced where that gas flow rate is comparatively low.

In some embodiments, said pump is configured to pump a gas flow rate through said first inlet that is over ten times higher than a gas flow rate through said intermediate inlet.

In particular, where the gas flow rate to the first inlet is significantly higher than the gas flow rate through the intermediate inlet, preferably more than ten times higher, then the risk of overloading of the pump caused by this additional gas being input to an already pumped gas flow will be significantly reduced, allowing such a pump to operate reliably and effectively.

In some embodiments, said vacuum pump is configured to pump a gas flow rate through said first inlet of between 5 and 10 slm.

In some embodiments, said vacuum pump is configured to provide a vacuum at said first inlet of between 3 and 5 mbar and at said intermediate inlet at a pressure suitable for backing a secondary pump.

In some embodiments, said pressure provided at said intermediate inlet is between 0.8 and 10 mbar preferably between 0.8 and 2.5 mbar.

A second aspect provides a method of differentially pumping multiple vacuum chambers in a vacuum system said method comprising: connecting said first inlet of a vacuum pump according to a first aspect to a lower vacuum chamber; and connecting said intermediate inlet to an exhaust of a high vacuum pump pumping a higher vacuum chamber.

The inventors of the present disclosure recognized that multiple chamber vacuum systems often have controlled gas flow between the chambers and the vacuums and gas flow rates required for the pumping of the different chambers are predictable, stable and related to each other. Furthermore, in many such vacuum systems the flow rate for pumping the higher vacuum chamber is often significantly lower than that required for pumping the lower vacuum chamber, making the flow rate at least suitable for input to an intermediate inlet, without unduly overloading the pump. Thus, such a system may be effectively pumped by a single multi-stage positive displacement pump with multiple inlets according to a first aspect. Using a single pump in this way reduces, the costs and space required and allows a single motor to drive the shaft(s) of a pump that effectively operates as multiple pumps.

In some embodiments, said vacuum system comprises a mass spectrometry system where pressure is reduced in stages through consecutive vacuum chambers, said vacuum chambers being connected via a restriction to control flow between said chambers.

Although the method may be suitable for pumping vacuum chambers in a multiple vacuum chamber system such as one associated with an electron microscope for example, it is particularly suitable for mass spectrometry where the gas flow rate is controlled between the chambers by restricted orifices and where the flow rate for pumping the higher vacuum chamber is significantly lower than that required for pumping the lower vacuum chamber.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Before discussing the embodiments in any more detail, first an overview will be provided.

A multi-stage positive-displacement vacuum pump such as a Roots pump can be configured with multiple inlets providing access to different stages of the pump. In this way what is effectively multiple pumps is provided within one pump housing.

These multiple inlets can be connected to different chambers and provide differential pumping of these chambers, such that pumping to different vacuums are provided by each inlet.

Such a pump may be provided by reconfiguring a conventional multi-stage pump to add an inlet to an intermediate stage and in some embodiments, to provide a diversion channel to divert the flow from the inlet stage around the intermediate stage. In this way what was previously a single pump with multiple stages is reconfigured to be effectively two pumps each with all or a subset of the stages of the original pump. The later stages towards the exhaust end are shared between the two pumps, while where there is a diversion channel, the earlier stages are specific to one of the two pumps.

Figure 1:
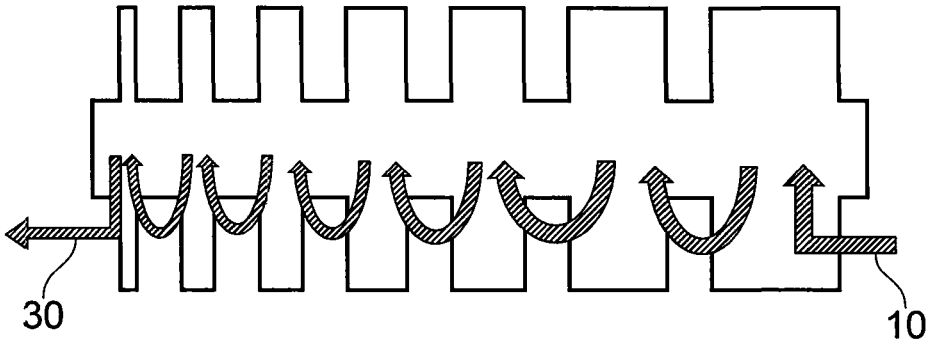
FIG. 1 schematically shows a multi-stage positive displacement pump according to the prior art.

FIG. 1 schematically shows a seven stage vacuum pump according to the prior art. As can be seen the stages of the vacuum pump progressively decrease in size as the pressure within the pump increases. The gas input inlet 10 is pumped through subsequent stages to exhaust 30 and is input at inlet 10 at a relatively low pressure and is output at exhaust 30 at atmospheric pressure. This pump may be a Roots or claw pump.

Figure 2:
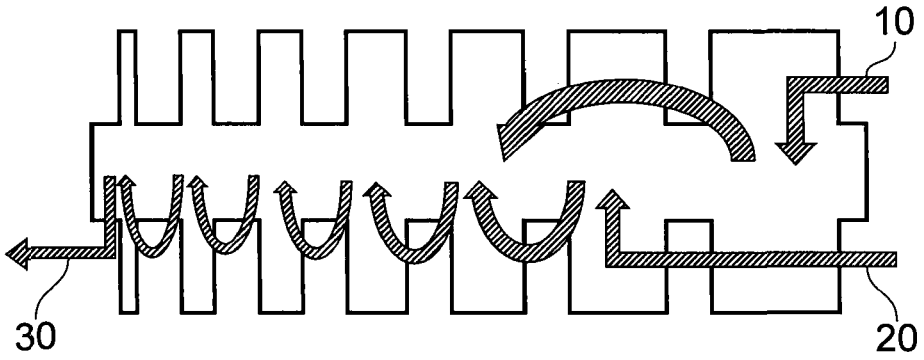
FIG. 2 schematically shows a multi-stage positive displacement pump according to a first embodiment.

FIG. 2 shows a similar seven stage vacuum pump according to an embodiment. This pump has a first inlet 10 connected to inlet stage 12 and an additional inlet 20 that provides access to an intermediate stage 22 of the pump. There are a further 5 stages, 32, 42, 52, 62 and 72 of the pump and an exhaust 30.

In this embodiment, gas from inlet 10 does not flow from the inlet stage 12 to the subsequent stage 22 as it does in the prior art pump, but is rather diverted along a diversion channel to the next but one stage 32. The stage 22 that the first gas flow is diverted around has an intermediate inlet 20 which receives a second gas flow. The diversion channel provides some isolation between inlet 20 and inlet 10 and allows the pressure at inlet 20 to not be so directly affected by the pressure of the gas output from the inlet stage 12 of the pump. Gas received at inlet 20 is compressed at the intermediate stage 22 and is sent on to the subsequent stage 32 where it combines with the gas input at inlet 10 and compressed by stage 12. The combined gas flow is then pumped through the pump to the exhaust 30. In this way, differential pumping via inlets 10 and 20 can be provided by a single pump.

In effect the single seven stage pump acts as two six stage pumps. One of the six stage pumps, pumps gas from inlet 10 via inlet stage 12 through stages 32, 42, 52, 62 and 72 to exhaust 30. The other six stage pump, pumps gas from inlet 20 via intermediate stage 22, through stages 32, 42, 52, 62, 72 to exhaust 30. Thus, in this embodiment stages, 32, 42, 52, 62 and 72 are shared stages that pump the gas input from both inlets, while input stage 12 pumps gas exclusively input from inlet 10 and intermediate stage 22 pumps gas exclusively input from gas inlet 20.

Figure 3:
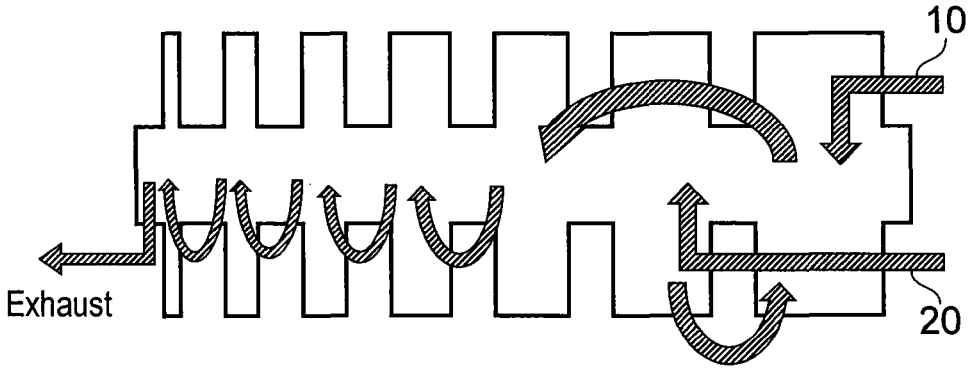
FIG. 3 schematically shows a positive displacement vacuum pump according to a second embodiment.

FIG. 3 shows an alternative embodiment where the intermediate stage 22 does not output to the subsequent stage 32 in the conventional way, but has a diversion channel such that the flow is diverted back to the inlet stage 12 where it mixes with gas from inlet 10. A further diversion channel then diverts the gas flow output from this stage 12 around the stage 22 of the intermediate inlet to the subsequent stage 32. In this way, the pressure of the gas input at inlet 20 can be higher than that input at gas inlet 10. Furthermore, the larger size of stage 12 compared to stage 22 makes the pump suitable for pumping a higher flow rate from inlet 10 and a lower flow rate from inlet 20. In this way, the pump is adapted to effectively differentially pump a higher flow rate, lower vacuum gas flow via inlet 10 and a higher vacuum, lower flow rate gas via inlet 20. This makes it particularly suitable for certain multiple chamber vacuum systems such as those used in mass spectrometers. In effect a seven stage pump with inlet 20 and exhaust 30 and a six stage pump with inlet 10 and exhaust 30 are provided.

Figure 4:
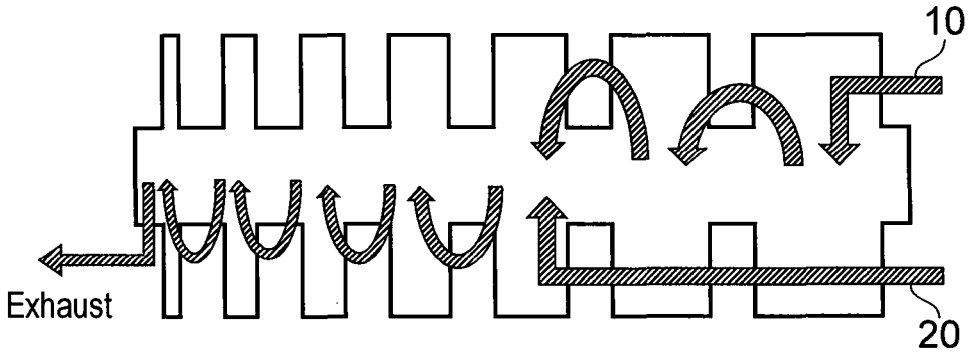
FIG. 4 schematically shows a positive displacement vacuum pump according to a third embodiment.

FIG. 4 schematically shows an alternative embodiment where the intermediate inlet 20 is provided in a later intermediate stage 32 of the multiple stage vacuum pump and combines with the gas pumped from the first inlet 10 at this intermediate stage 32. Such an arrangement would provide effective pumping where the gas flow at the intermediate inlet 20 is significantly lower than the gas flow at the first inlet 10.

Figure 5:
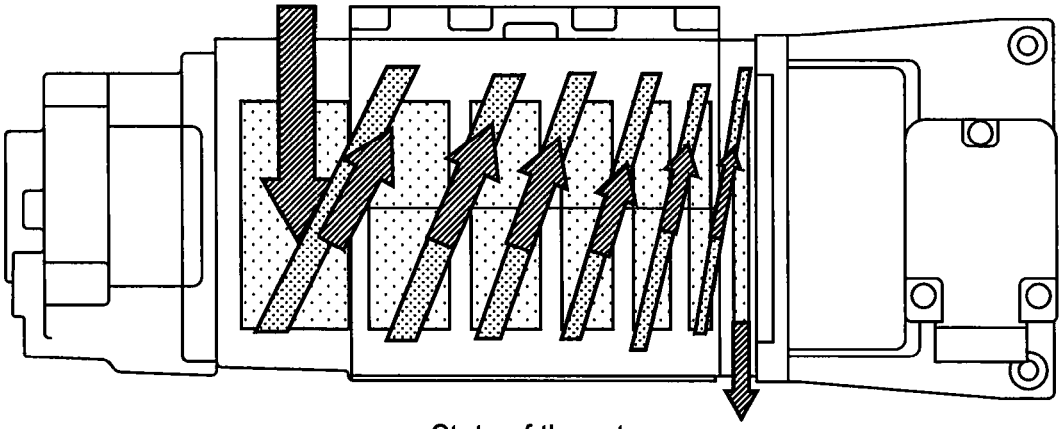
FIG. 5 shows a prior art multi-stage pump and the same pump adapted to form a multi-stage vacuum pump according to an embodiment.
Figure 5:
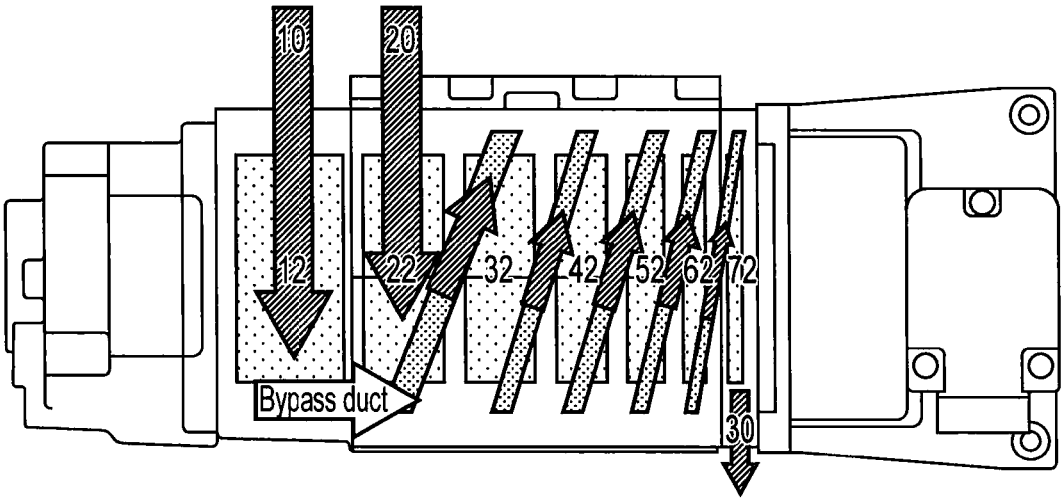

FIG. 5 schematically shows a multi-stage Roots pump of the prior art and the same pump adapted to form a multiple inlet multi-stage Roots pump according to the embodiment shown in FIG. 2. In particular, the port for gas flow between the inlet stage 12 and the second stage 22 of the prior art pump is blocked and a diversion channel or bypass duct is provided to the subsequent stage 32. Additionally, a port 20 is provided as an the intermediate inlet to the second stage 22. Adapting a pump in this way allows a conventional multi-stage positive displacement pump, such as a Roots, claw or screw pump to be adapted to provide a multiple inlet pump providing differential pumping at the multiple inlets.

In alternative embodiments, the pump may be designed with amended stage sizes to operate as a multi-stage positive displacement pump with multiple inlets. In this regard, admitting gas to an intermediate inlet and pumping a combined gas flow through some of the stages, will increase the loading on the pump where the combined pumping occurs. This may be acceptable in a conventionally sized pump where the gas flow rate admitted at the intermediate inlet is significantly smaller than that admitted at the first inlet. In such a case, a simple adaptation of a conventional pump can be made to provide the differential pumping functionality as shown in FIG. 5. If, however, a gas flow rate at the intermediate inlet that is more comparable to the gas flow rate at the main inlet is to be supported, then it may be that an adapted pump with increased stage sizes for the combined flow is required.

Figure 6:
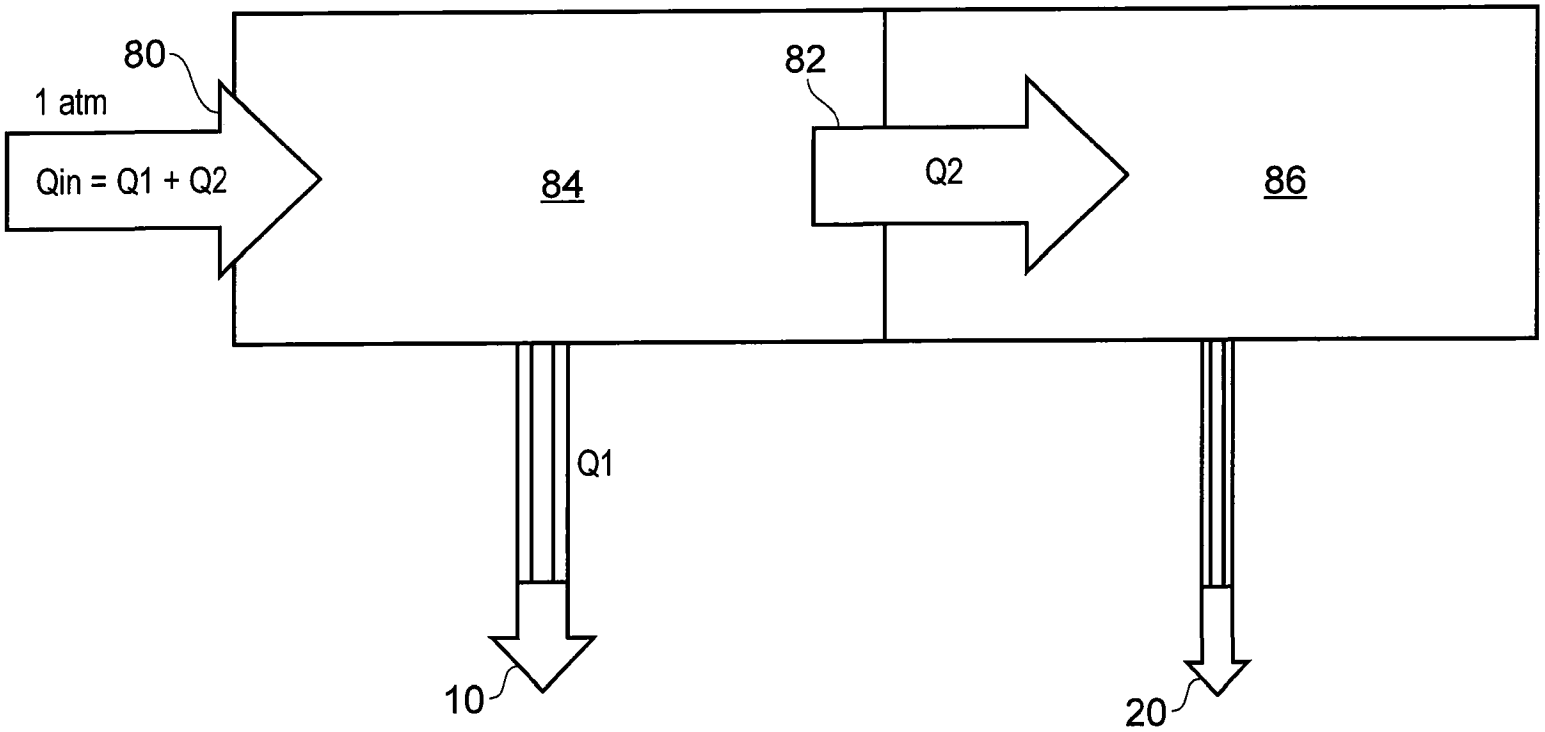
FIG. 6 shows multiple vacuum chambers of a mass spectrometer that is suitable for pumping by a vacuum pump according to an embodiment.

FIG. 6 shows a multiple vacuum chamber system to which pumps according to an embodiment may be attached to provide effective differential pumping of the different vacuum chambers. In this case, the system is a mass spectrometry system and the chambers each have orifices of a fixed size to control the flow rate into each of them. The primary inlet chamber 84 comprises an inlet orifice 80 and is held at a first vacuum and is pumped by a pump according to an embodiment via inlet 10, while the higher vacuum chamber 86 which is connected to the primary inlet chamber 84 via internal orifice 82 is pumped by a turbo pump which is backed by a pump according to an embodiment via intermediate inlet 20. The gas flow rate Q1 pumped from the primary chamber is significantly higher than that Q2 pumped from the higher vacuum chamber.

Thus, a pump according to an embodiment is attached at inlet 10 to the primary pumping line and the backing pumping line is attached to inlet 20. In some embodiments, the primary pumping line has a flow rate Q1 of 9 slm while the backing line has a significantly smaller flow rate Q2 of 0.5 slm. In this example, the volume of the two chambers is the order of ½ litre and the pressure in the primary inlet chamber is 4 mbar while the pressure required for backing the turbo pump is 2 mbar.

Thus, in this system where differential pumping is required and the flow rate from one chamber is significantly lower than the flow rate from the other, a single multi-stage positive displacement pump can effectively provide this differential pumping. In this regard, although the significantly lower flow rate is at a higher vacuum, and thus, it might seem that a multiple stage positive displacement pump with decreasing pump stages might not be suitable, this can be addressed by the use of diversion channels, which allow the higher vacuum, lower flow rate gas flow to be input to a smaller stage, and the lower vacuum, higher gas flow rate gas flow to be diverted around this stage. This provides improved independent control of the pressure of the two input stages.

It should be noted that although embodiments of these pumps are particularly effective at providing differential pumping of multiple vacuum chambers in a consecutively increasing vacuum system, they may also be used to provide differential pumping of other systems. Furthermore, although systems with only an inlet port and one intermediate port have been shown, further systems with additional intermediate ports may be provided. In such a case, it may be advantageous to have an increased number of stages.

Although in the embodiment shown the pump is a seven stage pump, a pump of four or more stages could operate with an additional intermediate inlet, and the number of stages selected will depend on the pumping requirements.

In embodiments, the pumps are used most effectively on gas flows that are limited by the system being pumped. This enables a large gas load during pump down to be avoided and running conditions to be provided that have a fairly constant gas load. Such conditions allow a positive displacement pump with one or more intermediate ports to function effectively and provide differential pumping of two or more chambers. Systems such as mass spectrometry systems have such characteristics and are conventionally pumped by multiple vacuum pumps. Being able to provide a reduced number of pumps to provide effective pumping of such systems is advantageous.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

The invention claimed is:

1. A multi-stage positive displacement vacuum pump comprising a plurality of inlets, the vacuum pump comprising:

a housing for housing at least one rotor mounted for rotation on a corresponding at least one shaft and for pumping gas through the multiple stages of the pump for output through an exhaust;

the housing comprising the plurality of inlets, the plurality of inlets comprising:

a first inlet configured to admit gas to an inlet stage of the vacuum pump; and a further inlet configured to admit gas to an intermediate stage of said vacuum pump; and a diversion channel for diverting gas flow from a pump stage on a first inlet side of the intermediate stage to a pump stage on an exhaust side of the intermediate stage, wherein the pump is configured such that gas admitted through each of the first and further inlets is pumped together as a combined gas flow by at least one stage of the vacuum pump downstream of the intermediate stage; and the vacuum pump is configured to differentially pump multiple chambers, the first inlet being configured to connect to a lower vacuum chamber and the intermediate inlet being configured to act as a backing pump for a vacuum pump pumping a higher vacuum chamber.

2. The multi-stage positive displacement vacuum pump according to claim 1, wherein the intermediate stage comprises an outlet for diverting flow pumped by the intermediate stage towards a pump stage on a first inlet side of the intermediate stage.

3. The multi-stage positive displacement vacuum pump according to claim 1, wherein the multi-stage positive displacement vacuum pump comprises one of a multiple stage Roots pump, a multiple stage claw pump or a multiple stage screw pump.

4. The multi-stage positive displacement vacuum pump according to claim 1, further comprising twin rotors mounted to rotate on twin shafts.

5. The multi-stage positive displacement vacuum pump according to claim 1, the multi-stage positive displacement vacuum pump comprising four or more stages arranged consecutively along the at least one shaft from said inlet stage, through a plurality of intermediate stages to an exhaust stage.

6. The multi-stage positive displacement vacuum pump according to claim 1, wherein the intermediate stage comprises one of a stage adjacent to the inlet stage or adjacent but one to the inlet stage.

7. The multi-stage positive displacement vacuum pump according to claim 1, wherein the multi-stage positive displacement vacuum pump is configured to pump at a higher gas flow rate through the first inlet than through the intermediate inlet.

8. The multi-stage positive displacement vacuum pump according to claim 7, wherein the multi-stage positive displacement pump is configured to pump a gas flow rate through the first inlet that is over ten times higher than a gas flow rate through the intermediate inlet.

9. The multi-stage positive displacement vacuum pump according to claim 8, wherein the vacuum pump is configured to pump a gas flow rate through the first inlet of between 5 and 10 slm.

10. The multi-stage positive displacement vacuum pump according to claim 7, wherein the vacuum pump is configured to provide a vacuum at the first inlet of between 3 and 5 mbar and at the intermediate inlet at a pressure suitable for backing a secondary pump.

11. The multi-stage positive displacement vacuum pump according to claim 10, wherein the pressure provided at the intermediate inlet is between 0.8 and 10 mbar.

12. The multi-stage positive displacement vacuum pump according to claim 10, wherein the pressure provided at the intermediate inlet is between 0.8 and 2.5 mbar.

13. A method of differentially pumping multiple vacuum chambers in a vacuum system, the method comprising:

connecting the first inlet of the multi-stage positive displacement vacuum pump according to claim 7 to a lower vacuum chamber; and connecting the intermediate inlet to an exhaust of a high vacuum pump pumping a higher vacuum chamber.

14. The method according to claim 13, wherein the vacuum system comprises a mass spectrometry system where pressure is reduced in stages through consecutive vacuum chambers, the vacuum chambers being connected via a restriction to control flow between the vacuum chambers.

* * * * *